US006832677B2

(12) United States Patent
Bohdan

(10) Patent No.: US 6,832,677 B2
(45) Date of Patent: Dec. 21, 2004

(54) CIGARETTE CHANNELING DEVICE WITH NON-RECTANGULAR CHANNEL EXIT

(75) Inventor: Walter Bohdan, Powhatan, VA (US)

(73) Assignee: Sasib Corporation of America, Richmond, VA (US)

( * ) Notice: Subject to any disclaimer, the term of this patent is extended or adjusted under 35 U.S.C. 154(b) by 0 days.

(21) Appl. No.: 10/197,582

(22) Filed: Jul. 18, 2002

(65) Prior Publication Data

US 2004/0011367 A1 Jan. 22, 2004

(51) Int. Cl.[7] ..... B65G 11/00; B66B 35/30

(52) U.S. Cl. ..... 193/2 R; 193/2 C; 53/149; 206/242

(58) Field of Search ..... 198/2 R, 2 C, 198/46; 53/148–151; 206/265–275

(56) References Cited

U.S. PATENT DOCUMENTS 2,258,516 A * 10/1941 Richardson ..... 193/2 R
2,653,497 A * 9/1953 Ebert et al. ..... 193/46
4,306,648 A * 12/1981 Manservisi et al. ..... 198/418.3
4,586,314 A * 5/1986 Monge et al. ..... 53/444
5,092,107 A * 3/1992 Lamm ..... 53/449
5,179,817 A * 1/1993 Barnes et al. ..... 53/148
5,590,513 A * 1/1997 Belvederi ..... 53/575
6,484,867 B2 * 11/2002 Spatafora et al. ..... 198/418.1

* cited by examiner

*Primary Examiner*—Christopher P. Ellis
*Assistant Examiner*—Mark A Deuble
(74) *Attorney, Agent, or Firm*—Stites & Harbison PLLC; Douglas E. Jackson

(57) ABSTRACT

A channeling device is provided for transferring and compressing a bundle of cigarettes formed into a rectangular configuration by a hopper into a preformed container. The channeling device includes a base having a longitudinal axis and a longitudinal channel through the base. The channel includes an entry portion having a lateral entry cross section which is rectangular and adapted to receive the bundle of cigarettes, and an exit portion having a non-rectangular exit cross section smaller than the entry cross section and adapted to deliver the bundle of cigarettes to a container having a matching non-rectangular cross section. An intermediate portion smoothly connects the entry portion to the exit portion. In one preferred embodiment, the non-rectangular cross section is flask-shaped. In another preferred embodiment, the non-rectangular cross section is polygonal, such as octagonal. In still another preferred embodiment, the non-rectangular cross section is oval shaped.

16 Claims, 2 Drawing Sheets

CIGARETTE CHANNELING DEVICE WITH NON-RECTANGULAR CHANNEL EXIT

BACKGROUND OF THE INVENTION

Typically when packaging cigarettes with a packaging machine, a cigarette hopper having a large number of cigarettes therein is used to arrange a bundle of the cigarettes for subsequent transfer and compression by a throat or compression device such that the compressed configuration is then transferred into a preformed cigarette container. The cigarette hopper includes one or more vertical or curved vanes, or a combination thereof, that arrange the cigarettes into a desired bundle configuration. The desired bundle configuration is a function of the number of cigarettes that the container is desired to contain. As well known in the art, such configurations can be: a 3 row, 7-6-7 or 7—7-6 configuration for 20 cigarettes per container; a 2 row, 5—5 configuration for 10 cigarettes per container; a 2 row, 9—9 configuration for 18 cigarettes per container; a 2 row, 10—10 configuration for 20 cigarettes per container; or a 3 row, 7—7—7 configuration for 21 cigarettes per container.

Regardless of the actual desired configuration used, the bundle of cigarettes is first formed into a loose rectangular configuration in the cigarette hopper. Thereafter, the rectangular bundle of cigarettes is transferred by a transfer mechanism into a compression drum or like device. The compression drum compresses the loose rectangular bundle transferred into an entry portion thereof by the transfer mechanism in both the width and length direction of the rectangular configuration, so that a compact rectangular bundle is thereafter moved by the (same or different) transfer mechanism from an exit portion of the compression drum. The transfer mechanism then effects movement of the compact bundle from the exit portion of the compression drum and insertion of this compact bundle into the container.

BRIEF SUMMARY OF THE INVENTION

In accordance with the present invention, a channeling device is provided for transferring and compressing a bundle of cigarettes formed into a rectangular configuration by a hopper into a preformed container. The channeling device includes a base having a longitudinal axis and a longitudinal channel through the base. The channel includes an entry portion having a lateral entry cross section which is rectangular and adapted to receive the loose bundle of cigarettes, and an exit portion having a non-rectangular exit cross section smaller than the entry cross section and adapted to deliver the compact bundle of cigarettes to a container having a matching non-rectangular cross section. An intermediate portion smoothly connects the entry portion to the exit portion.

In one preferred embodiment, the non-rectangular cross section is flask-shaped. In another preferred embodiment, the non-rectangular cross section is polygonal, such as octagonal. In still another preferred embodiment, the non-rectangular cross section is oval shaped.

In accordance with the preferred embodiment of the invention, the entry portion has a rounded circumferential edge. In addition, the intermediate portion includes a plurality of adjacent walls and intersections of the adjacent walls are rounded.

Also in the preferred embodiment, the loose bundle of cigarettes is laterally compressed to a greater degree in a width direction of the rectangular configuration than in a length direction of the rectangular configuration. In particular, the loose bundle of cigarettes is preferably laterally compressed in the width direction by about 1–10%.

It is an advantage of the present invention that a channeling device is provided which can deliver a rectangular bundle of cigarettes from a hopper into a non-rectangular cigarette container.

It is also an advantage of the present invention that the rectangular bundle of cigarettes from the hopper is incrementally converted into the non-rectangular shape of the non-rectangular cigarette container by the intermediate portion of the channeling device.

Other features and advantages of the present invention are stated in or apparent from detailed descriptions of presently preferred embodiments of the invention found hereinbelow.

DETAILED DESCRIPTION OF THE INVENTION

Figure 2:
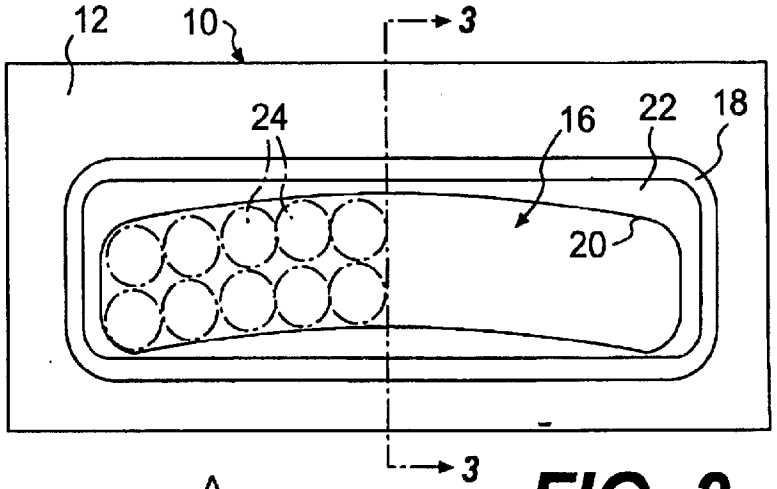
FIG. 2 is a top view of the channeling device depicted in FIG. 1.
Figure 3:
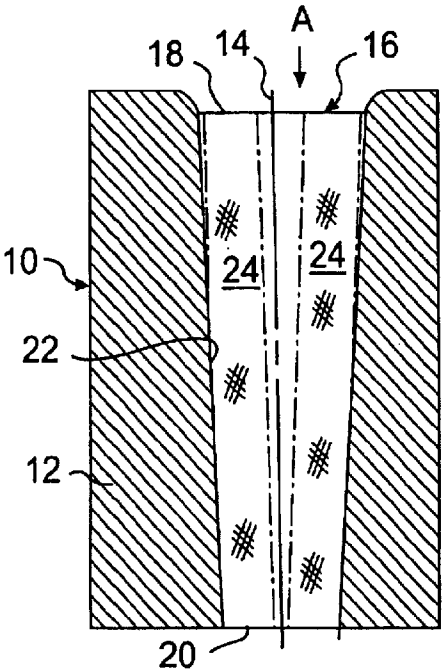
FIG. 3 is a cross-sectional view of the channeling device depicted in FIG. 1 taken along the line 3—3 in FIG. 2.
Figure 1:
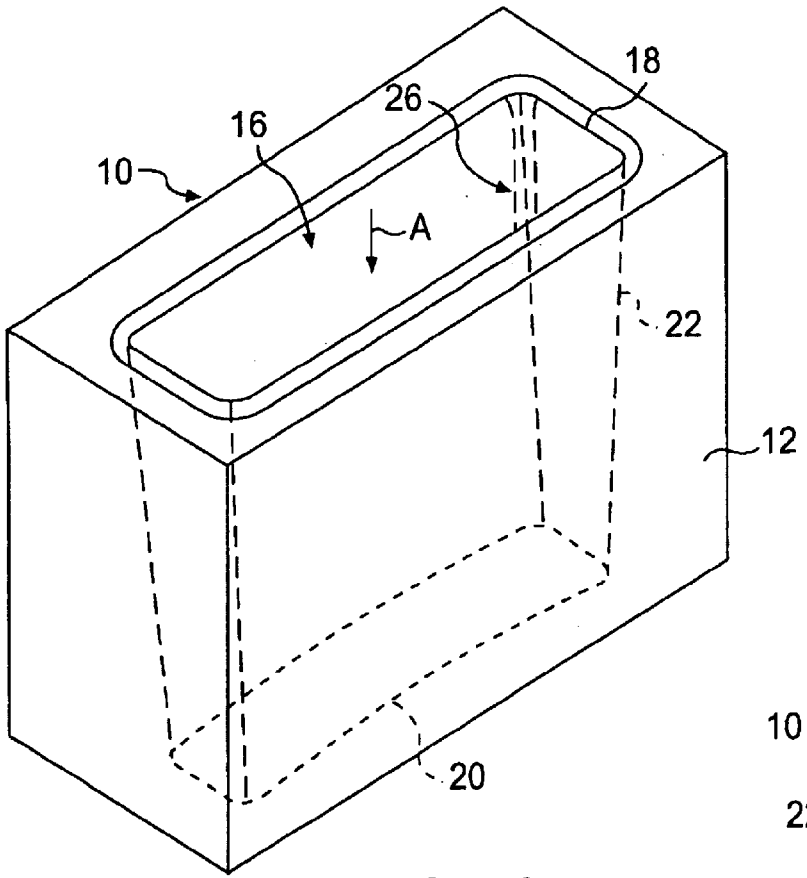
FIG. 1 is a top, front and left side perspective view of the channeling device of the present invention.

With reference now to the drawings in which like numerals represent like elements throughout the views, a channeling device 10 in accordance with a first embodiment of the present invention is depicted in FIGS. 1–3. Channeling device 10 includes a base 12, which in this embodiment is a generally parallelepiped shape making changing thereof in a suitable holding means in a cigarette packaging machine (not shown) relatively simple. Base 12 has a longitudinal axis 14 which is defined by the direction of movement shown by arrow A of a bundle of cigarettes therethrough.

Disposed along longitudinal axis 14 is a longitudinal channel 16 passing through base 12 from an entry portion 18 to an exit portion 20. Entry portion 18 and exit portion 20 are connected by an intermediate portion 22. As best shown in FIGS. 1–2, entry portion 18 has a cross section which is generally rectangular and through which a loose cigarette bundle of (plain or filter tipped) cigarettes 24 (shown with phantom lines for convenience) in a generally rectangular configuration is introduced from the cigarette hopper. Exit portion 20 has a generally non-rectangular cross section, which cross section in this embodiment is generally flask-shaped (parallel curved long sides) as shown and which is smaller than the cross section of entry portion 18. Exit portion 20 delivers a compact bundle of cigarettes 24 with a non-rectangular configuration to a preformed container (not shown) having a generally congruent non-rectangular cross section. In this embodiment, as shown best in FIG. 2, the bundle of cigarettes 24 is a bundle of twenty cigarettes in a 10—10 configuration.

Intermediate portion 22 smoothly connects entry portion 18 to exit portion 20. The smooth walls of intermediate portion 22 thus effect a compression of the bundle of cigarettes 24 as cigarettes 24 are transferred through channel 16 from a loose to a compact configuration, as well as from a rectangular configuration to a flask-shaped configuration. It will be noted that the intersections 26 of adjacent walls of intermediate portion 22 are rounded as shown to help provide a smooth movement of the cigarettes through channel 16 in the direction of arrow A.

In order to assure a smooth the delivery of the bundle of cigarettes 24 into entry portion 18 of channel 16, entry portion 18 includes a rounded circumferential edge 28 as best shown in FIG. 3. It will also be noted that in this preferred embodiment the loose bundle of cigarettes 24 is compressed by the movement thereof from entry portion 18 to exit portion 20 to a greater degree in a width direction of the rectangular configuration of the loose cigarette bundle as compared to the compression in a length direction thereof. In the preferred embodiment, the width compression is about 1–10% depending on the number of cigarettes in the bundle (as a loose bundle with more cigarettes can accept greater compression). Depending on the needs, the length compression of the loose bundle can be from about 0–10%.

Figure 4:
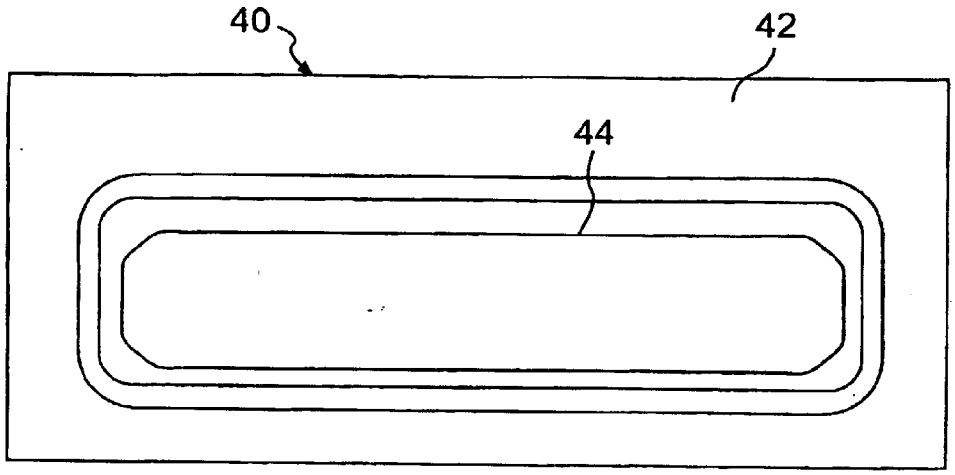
FIG. 4 is a top view of an alternative embodiment of a channeling device of the present invention.

Depicted in FIG. 4 is an alternative embodiment of a channeling device 40 of the present invention which is similar to channeling device 10. The elements of channeling device 40 which are similar to those of channeling device 10 will not be described in detail. Channeling device 40 includes an entry portion 42 substantially identical to entry portion 18, and an exit portion 44 similar to exit portion 20 except for its cross-sectional shape. Exit portion 44 is generally octagon shaped in cross section, with two long opposed sides as shown. The adjacent sides have slightly rounded intersections as shown. Cigarettes delivered through exit portion 44 would thus be inserted into a congruently shaped cigarette container.

Figure 5:
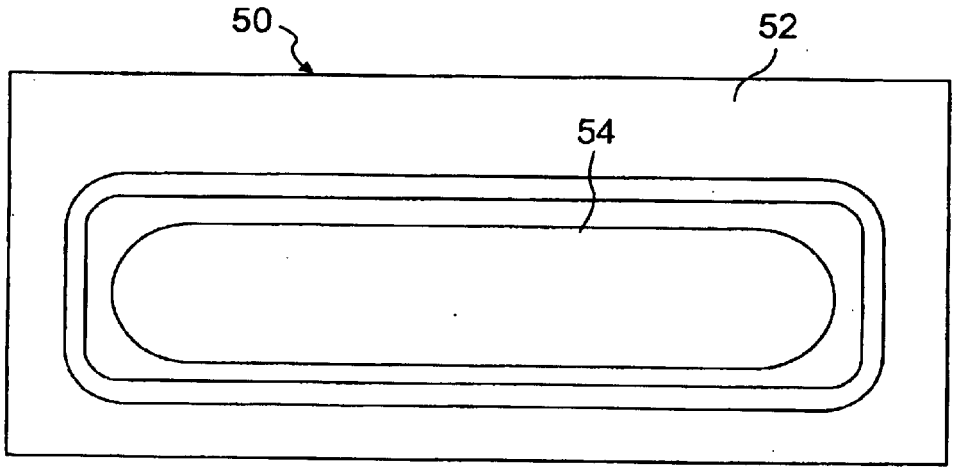
FIG. 5 is a top view of another alternative embodiment of a channeling device of the present invention.

Depicted in FIG. 5 is another alternative embodiment of a channeling device 50 of the present invention which is similar to channeling devices 10 and 40. The elements of channeling device 50 which are similar to those of channeling devices 10 and 40 will not be described in detail. Channeling device 50 includes an entry portion 42 substantially identical to entry portion 18, and an exit portion 54 similar to exit portions 20 and 44 except for its cross-sectional shape. Exit portion 54 is generally oval shaped in cross section, with two long opposed sides as shown. Cigarettes delivered through exit portion 54 would thus be inserted into a congruently shaped cigarette container.

Figure 6:
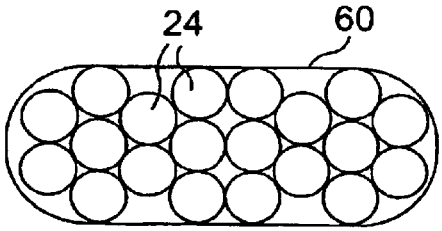
FIG. 6 is a bottom view of an oval exit portion with a compact bundle of cigarettes therein.

Depicted in FIG. 6 is an exit portion 60 of a channeling device (not otherwise shown for clarity) which is also of oval shape. The compact bundle of cigarettes 24 therein is disposed in this preferred embodiment in a lengthwise 2-3-2-3-3-2-3-2 configuration ready for entry into an oval cigarette container which is similarly oval shaped to exit portion 60.

While the non-rectangular cross section of exit portions 20, 44 and 54 have been depicted as being flask-shaped, octagonal and oval in FIGS. 1–5, it will be appreciated that other cross-sectional configurations of an exit portion of the present invention are possible. Thus, the cross section of the exit portion could be generally polygonal other than rectangular, such as triangular or hexagonal. Irregular polygonal cross sections are also possible, such as an irregular quadrilateral. Non polygonal cross sections besides flask-shaped and oval are also possible, such as elliptical or a completely ovular shape.

Thus, while the present invention has been described with respect to exemplary embodiments thereof, it will be understood by those of ordinary skill in the art that variations and modifications can be effected within the scope and spirit of the invention.

I claim:

1. A channeling device used in a cigarette packing machine said channeling device comprising:

an undivided base having a longitudinal axis; and a longitudinal channel through said base which is longitudinally smooth, said channel including a bundle of cigarettes therein, an entry portion having a lateral entry cross section which is rectangular and which receives the bundle of cigarettes therein, a cross section of the bundle of cigarettes at said entry portion being in a rectangular and uncompressed configuration, an exit portion having a non-rectangular exit cross section smaller than the entry cross section whereby a cross section of the bundle of cigarettes at said exit portion is in a non-rectangular and compressed configuration, said exit portion delivering the bundle of cigarettes to a preformed container having a matching non-rectangular cross section, and an intermediate portion which is laterally smooth, which smoothly connects said entry portion to said exit portion, and which is smoothly connected longitudinally to said entry portion and to said exit portion.

2. A channeling device as claimed in claim 1, wherein the non-rectangular exit cross section has two opposed length sides which are curved parallel to one another.

3. A channeling device as claimed in claim 1, wherein the non-rectangular exit cross section is polygonal.

4. A channeling device as claimed in claim 3, wherein the non-rectangular exit cross section is octagonal.

5. A channeling device as claimed in claim 1, wherein the non-rectangular exit cross section is oval shaped.

6. A channeling device claimed in claim 1, wherein the entry portion has a rounded circumferential edge.

7. A channeling device for claimed in claim 1, wherein the intermediate portion includes a plurality of adjacent walls and intersections of the adjacent walls are rounded.

8. A channeling device for claimed in claim 1, wherein the bundle of cigarettes is laterally compressed to a greater degree in a width direction of the rectangular configuration than in a length direction of the rectangular configuration.

9. A channeling device for claimed in claim 8, wherein the bundle of cigarettes is laterally compressed in the width direction by about 1–10%.

10. A channeling device used in a cigarette packing machine said channeling device comprising:

an undivided base having a longitudinal axis; and a longitudinal channel through said base which is longitudinally smooth, said channel including a bundle of cigarettes therein, an entry portion having a lateral entry cross section which is rectangular and which receives an initially rectangular bundle of cigarettes therein from a forming device of the cigarette packing machine, a cross section of the bundle of cigarettes at said entry portion being in a rectangular and uncompressed configuration, an exit portion having an exit cross sections said exit cross section (a) having two opposed length sides which are curved parallel to one another, and (b) being smaller than the entry cross sections whereby a cross section of the bundle of cigarettes at said exit portion has two opposed length sides which are similarly curved parallel to one another and is in a compressed configuration, said exit portion delivering the bundle of cigarettes to a preformed container having a cross section matching that of the exit cross section, and an intermediate portion which is laterally smooth, which smoothly connects said entry portion to said exit portion, and which is smoothly connected longitudinally to said entry portion and to said exit portion, wherein the bundle of cigarettes is laterally compressed to a greater degree in a width direction of the rectangular configuration than in a length direction of the rectangular configuration and the lateral compression in the width direction is about 1–10%.

11. A channeling device claimed in claim 10, wherein the entry portion has a rounded circumferential edge.

12. A channeling device for claimed in claim 11, wherein the intermediate portion includes a plurality of adjacent walls and intersections of the adjacent walls are rounded.

13. A channeling device used in a cigarette packing machine said channeling device comprising:

an undivided base having a longitudinal axis; and a longitudinal channel through said base which is longitudinally smooth, said channel including a bundle of cigarettes therein, an entry portion having a lateral entry cross section which is rectangular and which receives an initially rectangular bundle of cigarettes therein from a forming device of the cigarette packing machine, a cross section of the bundle of cigarettes at said entry portion being in a rectangular and uncompressed configuration, an exit portion having an oval-shaped exit cross section smaller than the entry cross section whereby a cross section of the bundle of cigarettes at said exit portion is in an oval-shaped and compressed configuration, said exit portion delivering the bundle of cigarettes to a preformed container having a matching oval-shaped cross section, and an intermediate portion which is laterally smooth, which smoothly connects said entry portion to said exit portion, and which is smoothly connected longitudinally to said entry portion and to said exit portion, wherein the bundle of cigarettes is laterally compressed to a greater degree in a width direction of the rectangular configuration than in a length direction of the rectangular configuration and the lateral compression in the width direction is about 1–10%.

14. A channeling device as claimed in claim 13, wherein the entry portion has a rounded circumferential edge.

15. A channeling device for as claimed in claim 14, wherein the intermediate portion includes a plurality of adjacent walls and intersections of the adjacent walls are rounded.

16. A channeling device as claimed in claim 14, wherein the oval-shaped exit portion accommodates a 2-3-2-3-3-2-3-2 bundle configuration of cigarettes.

* * * * *